US008719990B2

(12) United States Patent
Borofsky

(10) Patent No.: US 8,719,990 B2
(45) Date of Patent: May 13, 2014

(54) FLOOR CLEANING APPARATUS

(71) Applicant: Gary Richard Borofsky, Rydal, PA (US)

(72) Inventor: Gary Richard Borofsky, Rydal, PA (US)

(73) Assignee: Gary Richard Borofsky, Rydal, PA (US)

( * ) Notice: Subject to any disclaimer, the term of this patent is extended or adjusted under 35 U.S.C. 154(b) by 0 days.

(21) Appl. No.: 13/661,738

(22) Filed: Oct. 26, 2012

(65) Prior Publication Data

US 2013/0104327 A1 May 2, 2013

Related U.S. Application Data

(60) Provisional application No. 61/628,275, filed on Oct. 28, 2011, provisional application No. 61/629,366, filed on Nov. 18, 2011.

(51) Int. Cl.
*A47L 13/12* (2006.01)

(52) U.S. Cl.
USPC ..... 15/115; 15/244.2; 15/244.3

(58) Field of Classification Search
USPC ..... 15/114, 115, 118, 116.1, 116.2, 228, 15/244.1, 244.2, 244.3; D4/116; D32/42, D32/50
See application file for complete search history.

(56) References Cited

U.S. PATENT DOCUMENTS

| | | | | | |
|---|---|---|---|---|---|
| 1,563,829 | A | * | 12/1925 | Brown | 15/114 |
| 2,518,765 | A | * | 8/1950 | Ecker | 15/115 |
| 2,701,888 | A | | 2/1955 | Vosbikian et al. | |
| 2,845,644 | A | * | 8/1958 | Wisner | 15/114 |
| 3,274,635 | A | * | 9/1966 | Myers | 15/244.2 |
| 3,395,415 | A | * | 8/1968 | Leland | 15/121 |
| 3,474,480 | A | * | 10/1969 | Young | 15/114 |
| 3,778,860 | A | | 12/1973 | Thielen | |
| 3,906,580 | A | | 9/1975 | Smith et al. | |
| 5,522,110 | A | | 6/1996 | Borofsky | |
| 5,584,091 | A | | 12/1996 | Borofsky | |
| 6,979,371 | B1 | | 12/2005 | Policicchio et al. | |
| 8,166,597 | B2 | | 5/2012 | Levitt et al. | |
| 2004/0068817 | A1 | | 4/2004 | Policicchio | |
| 2005/0120499 | A1 | | 6/2005 | Kresse et al. | |
| 2005/0132518 | A1 | | 6/2005 | Chen et al. | |

(Continued)

*Primary Examiner* — Mark Spisich
(74) *Attorney, Agent, or Firm* — Tarolli, Sundheim, Covell & Tummino L.L.P.

(57) ABSTRACT

A floor cleaning implement, especially useful as grout mop, that has a rectangular base member having first and second longitudinal edges and a coupling member having at least two pivot axes for supporting swiveling movement between the base member and a handle. A brush bristle mounting structure forms part of the base member and carries at least one, but preferably two, longitudinal rows of bristle tufts located along one longitudinal edge. A cleaning pad is removably secured to the base member adjacent the longitudinal rows of bristle tufts. Supplementary rows of bristle tufts having a longitudinal extent substantially less than the longitudinal extent of the first row of bristle tufts are centrally positioned. The cleaning pad includes an arcuate recess to provide clearance for the supplementary rows of bristle tufts. The bristles of the first row of bristle tufts have a length that is less than a thickness of the cleaning pad and engage a floor to be cleaned by exerting compression forces on the cleaning pad in order to reduce the thickness of the cleaning pad to a dimension equal to or less than the length of the bristle tufts of the first row. The reversible cleaning pad is covered with a microfiber material which also serves as a "loop" material that is engageable with a "hook" material on the base member in order to mount the cleaning pad to the base member.

18 Claims, 2 Drawing Sheets

(56) References Cited

U.S. PATENT DOCUMENTS

2006/0248674 A1* 11/2006 Pisacane ..... 15/244.3
2006/0260078 A1 11/2006 Ranks
2007/0061987 A1 3/2007 Kresse et al.
2011/0056040 A1* 3/2011 Pisacane ..... 15/228

* cited by examiner

FLOOR CLEANING APPARATUS

RELATED APPLICATION

This application claims the benefit of U.S. Provisional Patent Application Ser. No. 61/628,275, filed on Oct. 28, 2011, and U.S. Provisional Patent Application Ser. No. 61/629,366, filed on Nov. 18, 2011, the disclosure of which is entirely incorporated herein by reference.

TECHNICAL FIELD

The present invention relates generally to cleaning devices and, in particular, a cleaning apparatus that includes an absorbent member for wiping a floor surface and a section of bristles that can be brought into contact with the floor when desired to provide a scrubbing function.

BACKGROUND ART

There are many cleaning implements on the market that are used to clean flooring. Examples of prior art cleaning implements are disclosed in U.S. Pat. Nos. 3,906,580; 5,522,110; 8,166,597; and U.S. Patent Publication No. 2007/0061987. It has been found that there is a need for an inexpensive, but effective cleaning implement for cleaning floors that have grout lines, such as those found in kitchens and bathrooms.

DISCLOSURE OF INVENTION

The present invention provides a new and improved cleaning apparatus that is especially adapted for cleaning floors. In particular, the cleaning apparatus can serve as a grout mop which includes features that facilitate the cleaning of grout lines that oftentimes are positioned below the overall level of the floor surface.

According to the preferred embodiment, the disclosed floor cleaning implement includes a rectangular base member having first and second longitudinal edges. A coupling member by which an operating handle is coupled to the base member allows swiveling movement between the base member and the operating handle. In a more preferred embodiment, the coupling member defines two pivot axes, preferably mutually orthogonal, which allow the swiveling movement. The base member includes structure or a mounting block for mounting brush bristle tufts. The bristle tufts are secured to the brush bristle mounting structure and are preferably arranged in a longitudinal row that is positioned adjacent one of the longitudinal edges of the base member. A cleaning pad is removably secured to the base member and is located adjacent the above-referenced row of bristle tufts. The pad member preferably has a thickness dimension that is greater than a length of the bristle tufts such that when the cleaning pad is in a relaxed position and in contact with a surface to be cleaned, i.e., floor, the bristle tufts are spaced from the surface to be cleaned.

According to the preferred embodiment, the bristle tufts are brought into contact with the surface to be cleaned by compressing the pad member to reduce its thickness. The compression forces on the pad member are exerted by the operator via the operating handle. For example, when a floor surface is being cleaned, the operator can exert downward forces on the base member via the handle in order to compress the pad member in order to bring the bristle tufts in contact with the floor.

In the illustrated embodiment, a second longitudinal row of bristle tufts is located adjacent the first row of bristle tufts.

The second row of bristle tufts is located intermediate the first row and the cleaning pad. According to this preferred embodiment, the length of the bristle tufts of the second row is less than the length of the bristle tufts of the first row. By making the bristle tufts of one row to have a greater length than the second row, engagement of the distal ends of the first row of bristle tufts with a thin grout line is greatly facilitated. If the bristle tufts of both rows are the same length, the second row of bristle tufts could inhibit sufficient compression of the pad member to enable the first row to enter a thin grout line, especially a grout line that is below the overall surface of the floor.

According to the illustrated embodiment, the cleaning implement includes one or more supplementary rows of bristle tufts that are located adjacent the second row. The longitudinal extent of the supplementary row is substantially less than the longitudinal extent of the first and second rows and, is centrally located on the base member. In the illustrated embodiment, the supplementary row (or rows) have about ⅓ the longitudinal extent of the first and second rows. According to this illustrated embodiment, the cleaning pad includes a recess, preferably arcuate, for providing clearance for the supplementary rows of bristle tufts.

The rows of bristle tufts are preferably offset with respect to each other so that the tufts of one row confront a gap between the bristle tufts of an adjacent row.

The cleaning pad itself preferably comprises an absorbent member, such as a urethane sponge, that is covered on all sides by a microfiber material. The cleaning pad is removably secured to the base member, preferably by a hook and loop material. In the illustrated embodiment, strips of hook material are suitably secured to the base member and the microfiber fabric of the pad member serves as the "loop" material. With the disclosed construction, the pad member can be easily removed and installed on the base member and is reversible in order to present either planar side in the floor cleaning position.

According to the preferred embodiment, the base member is preferably molded from acrylonitrile material and, in the illustrated embodiment, the brush bristle mounting structure is integrally molded with the base member. The individual bristles of each bristle tuft are made from polypropylene and have a diameter substantially 0.018 inches. In the illustrated embodiment, the distal ends of the bristle tufts are cut at an angle in order to promote cleaning.

The present invention provides a very effective cleaning tool which is especially adapted for cleaning grouted floors. When the user desires to clean a grout line of the floor, forces are exerted on the cleaning pad to compress its thickness, thus allowing the bristle tufts to engage and scrub the grout line. The loosened debris/dirt then is wiped by the cleaning pad member.

Additional features of the invention will become apparent and a fuller understanding obtained by reading the following detailed description made in connection with the accompanying drawings.

DETAILED DESCRIPTION OF THE INVENTION

Figure 1:
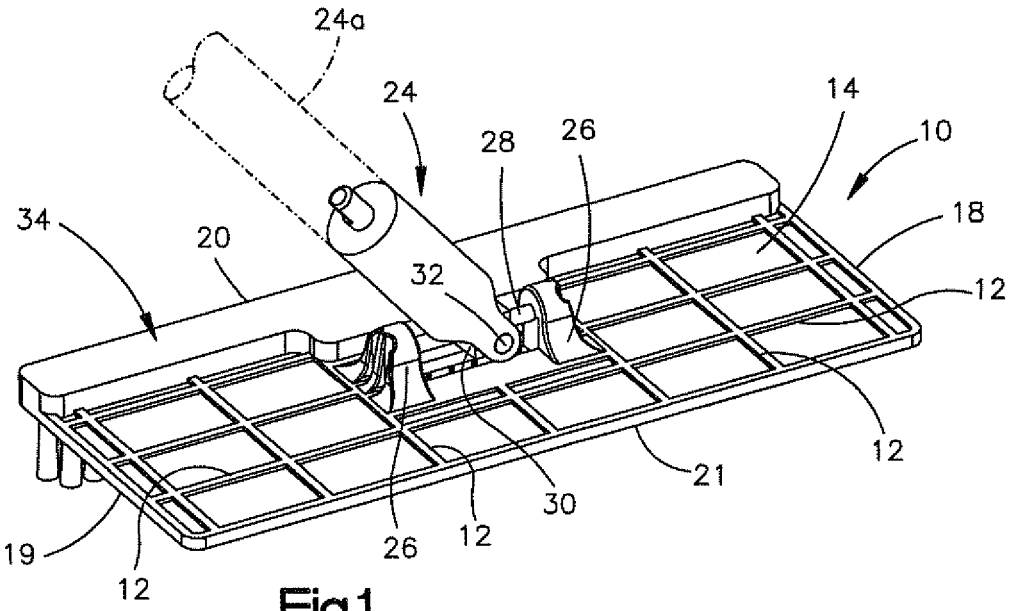
FIG. 1 is a perspective view of a base member that forms part of the cleaning apparatus of the present invention.

FIGS. 1-5 illustrate the overall construction of a cleaning apparatus constructed in accordance with a preferred embodiment of the invention. As seen in FIG. 1, the apparatus includes a base member 10 which may include rigidizing ribs 12 for stiffening the overall base member while reducing the material needed for the base member. In the preferred embodiment, the base member or pad holder is molded from acrylonitrile butadiene styrene. The base member has a top surface 14 and a bottom surface 16 (shown in FIG. 2). Preferably, the base member 10 is rectangular in shape and has two short sides 18, 19 and two long sides 20, 21.

Suitably attached to the top surface 14 is a handle coupling member indicated generally by the reference character 24. The coupling member 24 may include various structures by which a handle 24*a* is attached to the base member 10. For example, the coupling member 24 may include a threaded bore for receiving the threaded end of a elongate handle 24*a*. Other means for attaching a handle are contemplated by the invention. In the preferred embodiment, a coupling member is swivably attached to the base member 10. In the illustrated embodiment, a pair of upstanding lugs 26 mount a transverse pin 28 defining a first transverse axis by which a pivot block 30 forming part of the coupling member 24 is pivotally attached. The coupling member 24 includes another pivot axis defined by a pin 32 that is positioned transverse to the first pivot axis. With the disclosed swivel mechanism, the operating handle of the cleaning device can pivot front to back and side-to-side, thus allowing the handle to swivel with respect to the base member, in two directions which is especially useful when the device is used to clean (as will be explained) in close quarters.

Referring to FIGS. 1, 2, 3 and 5, the base member 10 includes a block-like structure 34 which may be integrally molded with the base member. The block structure 34 mounts a plurality of bristle tufts 36*a*, 36*b*, 36*c*, 36*d* (seen best in FIG. 2). It is contemplated that the brush block 34 may be a separate component which is suitably attached to the base member. In the preferred construction the bristle tufts are inserted into complementally shaped bores in the block structure 34 and are secured thereto by adhesive, staples, etc.

Figure 2:
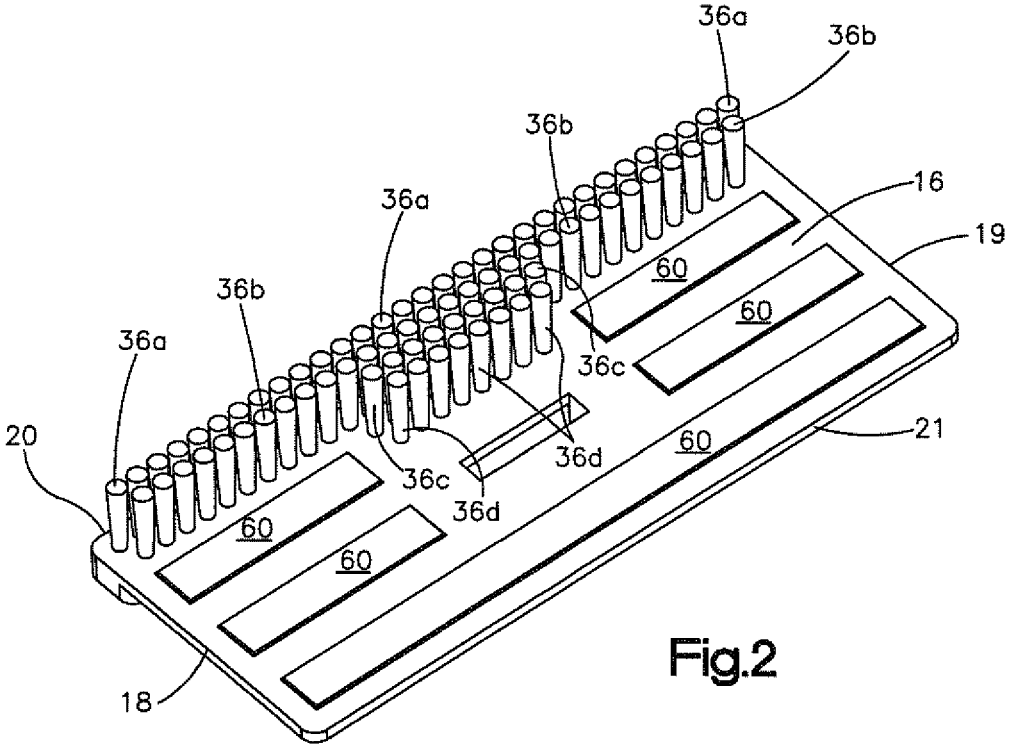
FIG. 2 is a perspective view showing an underside of the base member shown in FIG. 1.
Figure 3:
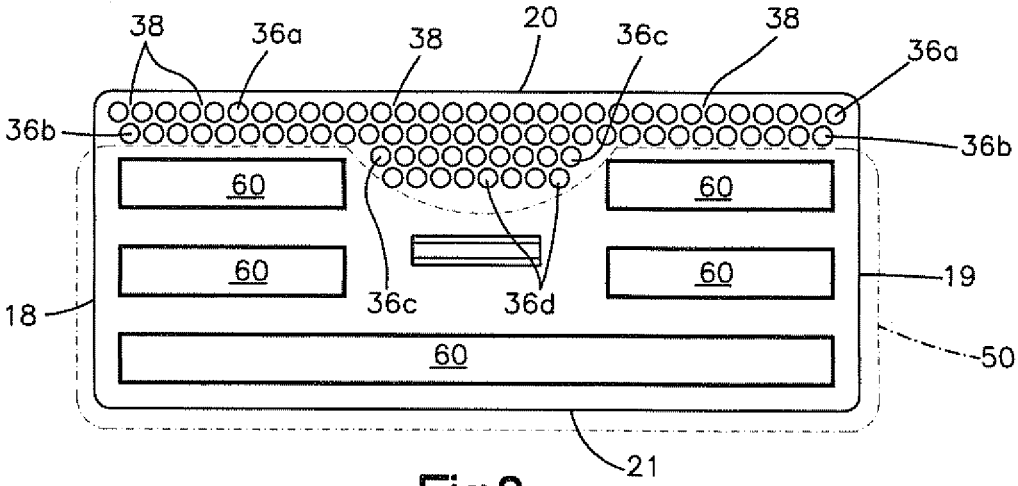
FIG. 3 is a plan view of the underside of the base member shown in FIG. 1 and also showing, in phantom, a pad member.
Figure 4:
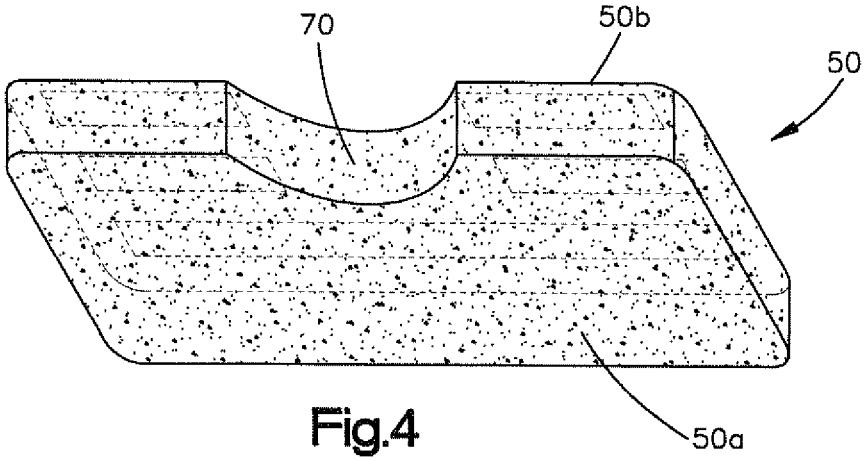
FIG. 4 is a perspective view of a pad member that forms part of the present invention and which is shown in phantom in FIG. 3.

As seen best in FIGS. 2 and 3, in the preferred embodiment, two longitudinal rows of bristle tufts are suitably mounted to the brush block portion 34. In a more preferred embodiment, the line of bristle tufts 36*a* (closest to the brush block longitudinal edge 20) is longer than an inner row of the bristle tufts 36*b*. The length of the inner row of bristle tufts 36*b* is shortened by reducing the number of bristle tufts that are mounted in the row. As seen best in FIG. 3, the bristle tufts 36*b* of the longitudinal inner row are offset with respect to the first row of bristle tufts 36*a* and, in particular, each bristle tuft 36*b* of the inner row confronts a gap 38 between bristle tufts 36*a* of the first row.

In the illustrated embodiment, two additional or supplementary rows of bristle tufts 36*c*, 36*d* are mounted to the inside of the inner row of bristle tufts 36*b* and are substantially shorter than either the row of bristle tufts 36*a* or the row of bristle tufts 36*b* and are centrally positioned. In the preferred and illustrated embodiment, the additional rows of tufts 36*c*, 36*d* are also of different lengths. In particular, the row of bristle tufts 36*c* immediately adjacent the row of bristle tufts 36*b* is about ⅓ the length of the row of bristle tufts 36*b*. the innermost row of bristle tufts 36*d* (that is adjacent the row of bristle tufts 36*c*) has one bristle tuft less than its adjacent row. As is the case with the first and second rows, the bristle tufts of the supplementary rows are located such that they confront the gap between bristle tufts of an adjacent row.

According to the invention, a cleaning pad 50 or other absorbent member is removably attached to the bottom surface 16 of the base member 10. In the preferred embodiment, the pad or member 50 comprises a urethane sponge that is covered on all sides by commercially available micro-fiber material. In the preferred construction, a plurality of hook and loop strips are suitable attached to the base member 10 and pad 50 (see FIG. 3). In one embodiment, strips of "hook" material 60 are suitably attached to the bottom surface 16 of the base member 10 and releasably engage the microfiber material of the cleaning pad 50 when the pad is pressed onto the base member 10. In this preferred construction, a strip of "loop" material need not be part of the pad member 50. The microfiber material serves as the "loop" material and directly engages the "hook" material that is secured to the bottom surface 16 of the base member 10.

With the preferred construction, the cleaning pad 50 is reversible so that either planar side 50*a*, 50*b* of the pad 50 can be attached to the base member 10.

In the preferred embodiment, the cleaning pad defines an arcuate recess 70 which provides clearance for the supplemental rows of bristle tufts 36*c*, 36*d*, thus providing increased scrubbing action in the center portion of the cleaning apparatus. It should be noted that for some applications, the supplemental rows of bristles 36*c*, 36*d* can be eliminated.

Figure 5:
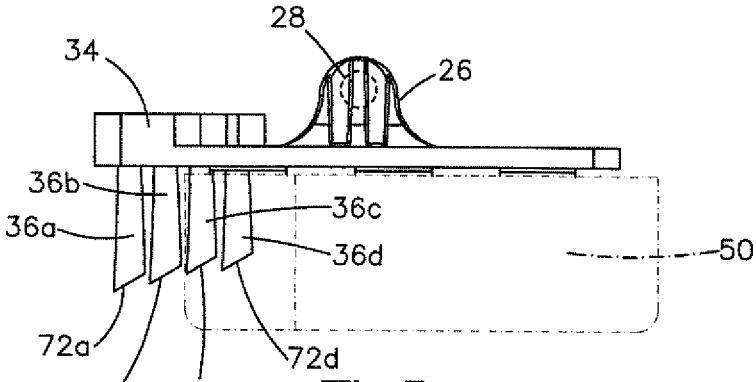
FIG. 5 is an end view of the base member shown in FIG. 1 with the pad member shown in phantom.

Referring in particular to FIG. 5, the relationship between the cleaning pad 50 and the bristles is illustrated. In the preferred embodiment, the bristles are made of polypropylene and the bristle tufts are suitably stapled to the block portion 34. The distal ends 72*a*, 72*b*, 72*c*, 72*d* of the bristle tufts 36*a*, 36*b*, 36*c*, 36*d* are preferably cut at an angle which is seen best in FIG. 5. The bristle diameter in the illustrated construction is 0.018 inches.

In the preferred and illustrated embodiment, the bristle tufts 36*a* are longer than the bristle tufts of the adjacent row of bristles. In one embodiment, the bristle tufts 36*b*, 36*c*, 36*d* of the adjacent rows are all the same length but shorter than the first row bristle tufts 36*a*. The invention also contemplates the bristle tufts 36*b*, 36*c*, 36*d* adjacent the first row having different lengths, but all being shorter than the bristle tufts 36*a* of the first row. With this construction, as will be explained, distal ends of the first row of bristle tufts will be able to drop into thin lines or recesses in a floor such as grout lines to provide thorough cleaning. If all bristle tufts were the same length, the bristle tufts 36*b*, etc. of the rows adjacent the bristle tufts 36*a* would resist the compression of the pad member 50 and thereby make it more difficult for the first row of bristle tufts 36*a* to engage or reach into a thin grout line.

As also seen in FIG. 5, in the preferred embodiment, the cleaning pad 50 has a thickness dimension that is greater than the length of the bristle tufts 36*a*. With this construction, in order to engage the bristle tufts with the floor being cleaned, the user must put pressure on the cleaning device to compress the cleaning pad 50 until the bristle tufts contact the floor. When the pressure is released, the cleaning pad returns to its uncompressed state and raises the bristles above the floor and, in this condition, the cleaning apparatus serves as a flat mop, etc.

With the disclosed invention, a very efficient and inexpensive cleaning apparatus for cleaning floors, especially floors with grout lines, is provided. This dual function cleaning device can be used as a grout mop to scrub grout lines when desired. This function does not require reconfiguring the cleaning apparatus or reorienting the cleaning apparatus, i.e., overturning the base member in order to position the bristles for cleaning the floor.

Although the invention has been described with a certain degree of particularity, it should be understood that those skilled in the art can make various changes to it without departing from the spirit or scope of the invention as hereinafter claimed.

The invention claimed is:

1. A floor cleaning implement comprising:

a) a rectangular base member having first and second longitudinal edges;

b) a coupling member by which an operating handle is coupled to said base member, said coupling member allowing swiveling movement between said base member and said operating handle;

c) brush bristle mounting structure forming part of said base member;

d) said brush bristle mounting structure mounting a plurality of bristle tufts, said bristle tufts arranged substantially in a longitudinal row adjacent said first longitudinal edge of said base member;

e) a cleaning pad removably secured to said base member, said cleaning pad located adjacent said row of bristle tufts, said pad member having a thickness dimension than is greater than a length of said bristle tufts, such that when said cleaning pad is in a relaxed condition and in contact with a surface to be cleaned, said bristle tufts are spaced from said surface to be cleaned;

f) a second longitudinal row of bristle tufts located adjacent said first row of bristle tufts and located intermediate said first row of bristle tufts and said cleaning pad, said bristle tufts of said second row having a length that is less than the length of said bristle tufts of said first row.

2. The cleaning apparatus of claim 1 wherein said bristle tufts are brought into contact with said surface to be cleaned by exerting compression forces on said cleaning pad.

3. The apparatus of claim 1 further comprising at least one supplementary row of bristle tufts located adjacent said second row and centrally positioned on said base member, said supplementary row having a longitudinal dimension that is substantially less than the longitudinal dimension of said first row.

4. The apparatus of claim 3 wherein said apparatus further comprises an additional row of supplementary bristle tufts outwardly positioned and located adjacent said first row of supplementary bristle tufts and centrally positioned.

5. The apparatus of claim 4 wherein said rows of bristle tufts are substantially parallel to each other.

6. The apparatus of claim 1 wherein the length of said first row of bristle tufts is greater than the length of said second row of bristle tufts.

7. The apparatus of claim 1 wherein said first and second rows of bristle tufts are offset so that the bristle tufts of one row confront a gap between bristle tufts of an adjacent row.

8. The apparatus of claim 1 wherein said cleaning pad is secured to said base member by at least one strip of hook and loop material.

9. The apparatus of claim 1 wherein said base member is molded from acrylonitrile.

10. The apparatus of claim 1 wherein said bristle tufts comprise bristles made from polyethylene having substantially a 0.018 diameter.

11. The apparatus of claim 1 wherein said bristle tufts are received in bores defined by said mounting structure and are secured thereto.

12. The apparatus of claim 1 wherein said coupling member defines at least two pivot axes which allow said operating handle to swivel with respect to said base member.

13. The apparatus of claim 1 wherein said base member includes rigidizing ribs for stiffening said base member.

14. A grout mop, comprising:

a) a rectangular base member having first and second longitudinal edges interconnected by transverse edges;

b) a coupling member by which an operating handle is coupled to said base member, said coupling member defining at least two pivot axes, whereby swiveling movement between said base member and said operating handle are permitted;

c) a brush bristle mounting structure forming part of said base member;

d) said brush bristle mounting structure mounting a plurality of bristle tufts, said bristle tufts arranged substantially in a longitudinal row of bristle tufts positioned adjacent said first longitudinal edge of said base member;

e) a cleaning pad removably secured to said base member, said cleaning pad located adjacent said row of bristle tufts, said pad member having a thickness dimension than is greater than a length of said bristle tufts, such that when said cleaning pad is in a relaxed condition and in contact with a surface to be cleaned, said bristle tufts are spaced from said surface to be cleaned;

f) at least one supplementary row of bristle tufts, said supplementary row having a longitudinal dimension substantially less than the longitudinal dimension of said first row and being centrally positioned with respect to said first row;

g) said cleaning pad having one longitudinal edge that corresponds to said second longitudinal edge of said base member and further includes a centrally positioned recess for providing clearance for said supplementary row of bristle tufts.

15. A floor cleaning implement comprising:

a) a rectangular base member having first and second longitudinal edges;

b) a coupling member by which an operating handle is coupled to said base member, said coupling member allowing swiveling movement between said base member and said operating handle;

c) brush bristle mounting structure forming part of said base member;

d) said brush bristle mounting structure mounting a plurality of bristle tufts, said bristle tufts arranged substantially in a longitudinal row adjacent said first longitudinal edge of said base member;

e) a cleaning pad removably secured to said base member, said cleaning pad located adjacent said row of bristle tufts, said pad member having a thickness dimension than is greater than a length of said bristle tufts, such that when said cleaning pad is in a relaxed condition and in contact with a surface to be cleaned, said bristle tufts are spaced from said surface to be cleaned, and said cleaning pad being secured to said base member by at least one strip of hook and loop material.

16. The apparatus of claim 15 wherein said cleaning pad comprises an absorbent member covered by microfiber material.

17. The apparatus of claim 16 wherein said cleaning pad is reversibly mountable to said base member.

18. The apparatus of claim 16 wherein said microfiber material acts as a hook and loop material itself and is directly engaged by the strip of hook and loop material forming part of said base member.

* * * * *